US011166615B2

(12) United States Patent
Oblinger

(10) Patent No.: US 11,166,615 B2
(45) Date of Patent: Nov. 9, 2021

(54) DISHWASHER COMPRISING A HYDRAULIC ARRANGEMENT FOR CLEANING A FILTER DEVICE

(71) Applicant: BSH Hausgeräte GmbH, Munich (DE)

(72) Inventor: Anton Oblinger, Wertingen (DE)

(73) Assignee: BSH Hausgeräte GmbH, Munich (DE)

( * ) Notice: Subject to any disclaimer, the term of this patent is extended or adjusted under 35 U.S.C. 154(b) by 94 days.

(21) Appl. No.: 16/475,143

(22) PCT Filed: Feb. 9, 2018

(86) PCT No.: PCT/EP2018/053260
§ 371 (c)(1),
(2) Date: Jul. 1, 2019

(87) PCT Pub. No.: WO2018/153686
PCT Pub. Date: Aug. 30, 2018

(65) Prior Publication Data

US 2019/0328205 A1 Oct. 31, 2019

(30) Foreign Application Priority Data

Feb. 21, 2017 (DE) ..... 10 2017 202 783

(51) Int. Cl.
*A47L 15/42* (2006.01)
*A47L 15/00* (2006.01)
(Continued)

(52) U.S. Cl.
CPC ..... *A47L 15/4208* (2013.01); *A47L 15/0055* (2013.01); *A47L 15/14* (2013.01);
(Continued)

(58) Field of Classification Search
CPC ..... A47L 15/4208; A47L 15/4221; A47L 15/4225; A47L 15/44
See application file for complete search history.

(56) References Cited

U.S. PATENT DOCUMENTS

2005/0230427 A1* 10/2005 Salvati ..... D06F 39/02 222/241
2012/0006355 A1* 1/2012 Heidel ..... A47L 15/0049 134/10

(Continued)

FOREIGN PATENT DOCUMENTS

DE 3745169 C2 7/1999
DE 10244243 A1 3/2004

OTHER PUBLICATIONS

National Search Report DE 10 2017 202 783.5 dated Jan. 8, 2018.
International Search Report PCT/EP2018/053260 dated Jun. 11, 2018.

*Primary Examiner* — Spencer E. Bell
(74) *Attorney, Agent, or Firm* — Michael E. Tschupp; Andre Pallapies; Brandon G. Braun

(57) ABSTRACT

A dishwasher includes a dishwashing container accommodating items to be washed. A first hydraulic arrangement is provided to wash the items by a dishwashing fluid and includes a spray device arranged in the dishwashing container, a sump arranged below the dishwashing container, a filter device configured to filter the dishwashing fluid in the dishwashing container and/or the sump, and a circulating pump configured to circulate the dishwashing fluid to the spray device. A second hydraulic arrangement is provided for cleaning the filter device by a cleaning fluid. The second hydraulic arrangement includes the filter device, the sump, a pump arrangement, a storage device for holding the cleaning fluid, a cleaning device for spraying at least one segment of the filter device with the cleaning fluid, and an auxiliary pump arranged between the storage device and the cleaning device for applying pressure to the cleaning fluid.

7 Claims, 5 Drawing Sheets

(51) Int. Cl.
*A47L 15/14* (2006.01)
*A47L 15/44* (2006.01)

(52) U.S. Cl.
CPC ..... *A47L 15/4225* (2013.01); *A47L 15/44* (2013.01); *A47L 2501/04* (2013.01); *A47L 2501/05* (2013.01)

(56) References Cited

U.S. PATENT DOCUMENTS

| | | | | |
|---|---|---|---|---|
| 2012/0118339 | A1* | 5/2012 | Ertl ..... | A47L 15/4217 134/186 |
| 2012/0167928 | A1 | 7/2012 | Fountain et al. | |
| 2012/0312337 | A1 | 12/2012 | Boyer et al. | |
| 2013/0186441 | A1 | 7/2013 | Ak et al. | |

* cited by examiner

DISHWASHER COMPRISING A HYDRAULIC ARRANGEMENT FOR CLEANING A FILTER DEVICE

CROSS-REFERENCES TO RELATED APPLICATIONS

This application is the U.S. National Stage of International Application No. PCT/EP2018/053260, filed Feb. 9, 2018, which designated the United States and has been published as International Publication No. WO 2018/153686 A1 and which claims the priority of German Patent Application, Serial No. 10 2017 202 783.5, filed Feb. 21, 2017, pursuant to 35 U.S.C. 119(a)-(d).

BACKGROUND OF THE INVENTION

The present invention relates to a dishwasher with a first hydraulic arrangement for washing items to be washed and a second hydraulic arrangement for cleaning a filter device of the dishwasher, as well as a method for operating such a dishwasher.

A dishwasher can have a hydraulic circuit arrangement for washing items to be washed that are accommodated in a dishwashing container by circulating a dishwashing fluid from a sump in the lower region of the dishwashing container to a spray device. The hydraulic circuit arrangement can comprise a filter device arranged above the sump, for example a cylindrical filter, for filtering dirt particles from the dishwashing fluid. Such a filter device should be cleaned at regular intervals to ensure an optimum dishwashing performance.

EP 2 462 857 A1 describes a dishwasher with rotating filters, which rotate with a sword geometry, the raising and lowering of pressure causing dirt particles to be crushed.

WO 2011/076650 A1 shows additional spray devices in the center of a cylindrical filter, which clean the radial outer cylindrical filter by means of a volumetric flow from a circulating pump by applying pressure, with water present in the cylindrical filter.

DE 3 745 169 C2 describes a rotating cup-shaped filter and a line connected to a fresh water supply, which has an outlet opening, from which a jet of fresh water is directed onto the rotating filter, while a discharge pump operates.

BRIEF SUMMARY OF THE INVENTION

Against this background it is the object of the present invention to improve the automatic cleaning of a filter device of a dishwasher.

According to a first aspect a dishwasher, in particular a household dishwasher, is proposed, which has a first hydraulic arrangement for washing items to be washed that are accommodated in a dishwashing container by means of a dishwashing fluid, and a second hydraulic arrangement for cleaning a filter device by means of a cleaning fluid. The first hydraulic arrangement comprises a spray device arranged in the dishwashing container, a sump arranged below the dishwashing container, the filter device for filtering the dishwashing fluid arranged in the dishwashing container and/or the sump and a circulating pump, which is designed to circulate the dishwashing fluid to the spray device. The second hydraulic arrangement comprises the filter device, the sump, a pump arrangement, a storage device for holding the cleaning fluid, a cleaning device for spraying at least one segment of the filter device with the cleaning fluid and an auxiliary pump arranged between the storage device and the cleaning device for applying pressure to the cleaning fluid.

The first hydraulic arrangement is in particular a hydraulic circuit, in which dishwashing fluid is circulated to wash items to be washed, which are accommodated in at least one dish holder in the dishwashing container.

The dishwashing fluid or dishwashing liquor is water, to which chemicals, such as detergent or rinse aid, can be added, which is circulated in a circuit by the circulating pump to wash the items to be washed and which can contain dirt particles.

The spray device comprises at least one apparatus for spraying the items to be washed with the dishwashing fluid. The respective apparatus can be for example a rotating spray arm or a nozzle installed in a fixed position in the dishwashing container.

The sump is a holder for fluid arranged below the dishwashing container, located upstream of a pump, for example the circulating pump or a drain pump. The filter device is formed by one or more filters for example and is arranged in such a manner that, after spraying the items to be washed, the dishwashing fluid passes through the filter device to reach the sump, so that at least some of the dirt particles contained in the dishwashing fluid are retained by the filter device.

The second hydraulic arrangement can be a hydraulic circuit or an arrangement of hydraulic devices, which is at least sometimes not closed to form a circuit. Some of the hydraulic devices of the second hydraulic arrangement can also be included in the first hydraulic arrangement. A cleaning fluid for cleaning the filter devices is conveyed and/or circulated in the second hydraulic arrangement.

The cleaning fluid can be the dishwashing fluid or another fluid.

The pump arrangement is an arrangement comprising one or more pumps, each of which is designed to pump cleaning fluid out of the sump while the filter device is being cleaned. The pumps of the pump arrangement can be operated simultaneously or in an alternating manner here.

The storage device serves to hold cleaning fluid for cleaning the filter device. The storage device can be a dishwashing liquor storage unit, a tank of a heat exchanger, a capacitor container of a heat pump-type dishwasher, a water pocket or any other hollow vessel or reservoir suitable for holding cleaning fluid. The reservoir has a capacity of between 1 l and 10 l and preferably 2 l for example.

The cleaning device is an arrangement comprising one or more apparatuses, for example outlet openings or nozzles, which together are designed to spray at least one segment of the filter device with the cleaning fluid. The cleaning device can be fixed or movable relative to the filter device, it being possible for the filter device for its part to be fixed or movable relative to the cleaning device.

The auxiliary pump is an additional pump, which is in particular not part of the first hydraulic arrangement for washing the items to be washed and which is designed to apply pressure to the cleaning fluid.

The auxiliary pump can advantageously freely select the volumetric flow and pressure of the cleaning fluid for an optimum cleaning effect for the filter device regardless of the parameters of the circulating pump, when the filter device is being sprayed.

The combination of the auxiliary pump and the storage device for holding the cleaning fluid upstream of the auxiliary pump advantageously means there is no need for a separate pressure valve for fresh water for cleaning the filter device.

If the water for cleaning is taken from the storage device, the storage device can be at least partially filled with dishwashing liquor, thereby reducing fresh water consumption for cleaning the filter device.

According to one embodiment of the dishwasher the pump arrangement of the second hydraulic arrangement comprises the circulating pump, which is also designed to circulate the cleaning fluid to the storage device.

If the pump arrangement comprises the circulating pump, the second hydraulic arrangement can form a hydraulic circuit, in which cleaning fluid from the pump circuit is circulated to the storage device, with the result that multiple use of the same cleaning fluid reduces water consumption for cleaning the filter device.

According to one embodiment of the dishwasher the pump arrangement of the second hydraulic arrangement comprises a drain pump for conveying the cleaning fluid into a sewage line.

If the pump arrangement comprises the drain pump or discharge pump, soiled cleaning fluid can be conveyed into the sewage.

According to one embodiment of the dishwasher a water switch is arranged between the circulating pump, the spray device and the storage device, an inlet of the water switch being connected to an outlet of the circulating pump, a first outlet of the water switch being connected to an inlet of the spray device and a second outlet of the water switch being connected to an inlet of the storage device.

The water switch is an apparatus with an inlet and a number of outlets, which is designed to distribute fluid entering by way of the inlet among the number of outlets.

The water switch allows at least some of the dishwashing fluid, which is circulated in the first hydraulic, to be conducted into the storage device, thus allowing at least some of the cleaning fluid to be formed from the dishwashing fluid.

According to one embodiment of the dishwasher at least some of the cleaning fluid is formed from the dishwashing fluid.

Using dishwashing fluid as cleaning fluid can advantageously reduce fresh water consumption for cleaning the filter device. Also the chemicals contained in the dishwashing fluid can have a cleaning effect for the filter device.

According to one embodiment of the dishwasher the storage device has a fresh water connection for filling the storage device with fresh water and the at least some of the cleaning fluid is formed from fresh water.

The fresh water connection allows the storage device to be filled with fresh water for example at the start of the cleaning of the filter device. Using fresh water increases the level of cleaning of the cleaning fluid.

According to one embodiment of the dishwasher the storage device has a dosing apparatus for adding chemicals to the cleaning fluid in the storage device.

The dosing apparatus can be for example an automatic dosing system (ADS) and the chemicals can be one or more agents such as detergents, rinse aid or other chemicals that improve the cleaning effect of the cleaning fluid for the filter device. Adding chemicals to the cleaning fluid in the storage device is particularly advantageous, if the cleaning fluid is formed from fresh water.

According to one embodiment of the dishwasher the filter device comprises a number of filters. For example one filter of the number of filters can be a flat filter arranged horizontally. One filter of the number of filters can also be shaped such that it forms the lateral surface of a vertically arranged unit with an upper and lower opening.

According to one embodiment of the dishwasher one filter of the number of filters of the filter device is configured as a cylindrical filter. In one variant of the present embodiment the cleaning device can be arranged inside the cylindrical filter and be designed to spray cleaning fluid in particular radially outward against the inner lateral surface of the cylindrical filter.

In a further variant of the present embodiment the cleaning device can be arranged outside the cylindrical filter and be designed to spray cleaning fluid radially inward, at an angle to the radial direction inward or tangentially against the outer lateral surface of the cylindrical filter. Depending on the arrangement of the cleaning device according to the cited variants, the filter device can be cleaned in the flow direction or counter to the flow direction.

According to one embodiment a volumetric flow of the auxiliary pump is smaller than a volumetric flow of the pump arrangement. If the pump arrangement discharges cleaning fluid with a volumetric flow that is greater than the volumetric flow with which the auxiliary pump conveys the cleaning fluid to the cleaning device, it means that cleaning fluid does not collect in proximity to the segment of the filter device sprayed by the cleaning device.

If the sprayed segment of the filter device is a cylindrical filter for example, according to the present embodiment there is no column of fluid in the cylindrical filter while the cylindrical filter is sprayed with cleaning fluid. This improves the cleaning effect for the cylindrical filter. In particular, if the cleaning device is arranged inside the cylindrical filter, it prevents a column of fluid present in the cylindrical filter slowing down the cleaning fluid sprayed out of the cleaning device before it strikes the cylindrical filter. If the cleaning device is arranged outside the cylindrical filter, it prevents dirt particles released from the filter by the sprayed cleaning device being impeded as they exit the cylindrical filter.

According to one embodiment of the dishwasher the auxiliary pump is designed to apply an additional pressure between 0.5 bar and 20 bar to the cleaning fluid.

When a high level of pressure is applied by the auxiliary pump, as in the present embodiment, the cleaning effect is better than when pressure is applied to the cleaning fluid for example by a circulating pump. While a circulating pump is designed for example for low pressures, which do not damage the items to be washed that have been placed in the dishwashing chamber, higher pressures can be reached with the auxiliary pump to improve the cleaning effect for the filter device.

According to a second aspect a method for operating a dishwasher, in particular a household dishwasher, is proposed. The method comprises: washing items to be washed that are accommodated in a dishwashing container by circulating a dishwashing fluid in a first hydraulic arrangement by means of a circulating pump and cleaning the filter device by means of cleaning fluid in a second hydraulic arrangement. The first hydraulic arrangement comprises a spray device arranged in the dishwashing container, a sump arranged below the dishwashing container, a filter device for filtering the dishwashing fluid arranged in the dishwashing container and/or the sump and the circulating pump. The second hydraulic arrangement comprises the filter device, the sump, a pump arrangement, a storage device for holding the cleaning fluid, a cleaning device and an auxiliary pump arranged between the storage device and the cleaning device. The cleaning of the filter device by means of the cleaning fluid in the second hydraulic arrangement comprises: pumping the cleaning fluid out of the storage device to the cleaning device subject to the application of pressure by the auxiliary pump, spraying at least one segment of the filter device with a cleaning fluid by means of the cleaning device and pumping the cleaning fluid out of the sump by means of the pump arrangement.

The embodiments and features described for the proposed dishwasher apply correspondingly to the proposed method.

BRIEF DESCRIPTION OF THE DRAWINGS

Further advantageous embodiment of the dishwasher are set out in the subclaims and the exemplary embodiments of the dishwasher described in the following. The dishwasher is also described in more detail based on preferred embodiments with reference to the accompanying figures.

DETAILED DESCRIPTION OF EXEMPLARY EMBODIMENTS OF THE PRESENT INVENTION

Figure 1:
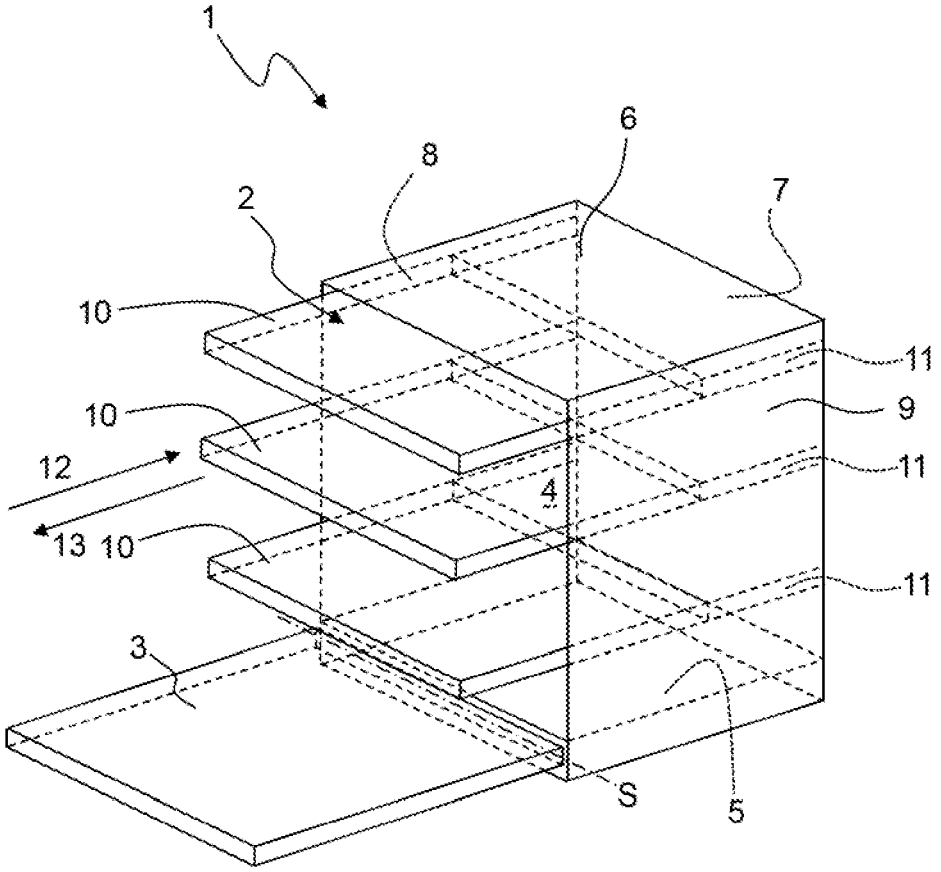
FIG. 1 shows a schematic perspective view of an exemplary embodiment of a dishwasher.

Identical elements or those of identical function are shown with the same reference characters in the figures, unless otherwise specified.

FIG. 1 shows a schematic perspective view of an exemplary embodiment of a dishwasher 1. The dishwasher 1 is a household dishwasher. The dishwasher 1 has a carcass, which comprises a dishwashing container 2, as well as a door 3. The dishwashing container 2 and door 3 form a dishwashing chamber 4 for washing items to be washed. The door 3 is shown in its opened position in FIG. 1. The door 3 can be closed or opened by pivoting about a pivot axis S provided at a lower end of the door 3. The dishwashing container 2 is box-shaped for example and can comprise a base 5, a top 6 positioned opposite the base 5, a rear wall 7 positioned opposite the door 3 and two opposing side walls 8, 9. The side walls 8, 9 in particular can be made of stainless steel. The dishwasher 1 also has at least one dish holder 10. A number of dish holders 10 in particular can be provided, comprising a lower rack, an upper rack and/or a flatware drawer. The several dish holders 10 are preferably arranged one above the other in the dishwashing container 2. Each dish holder 10 can be moved as required into an initial position in the dishwashing container 2 in an insertion direction 12 or out of it to an end position in a pull-out direction 13. A rail 11 is provided on both sides of a respective dish holder 10 for this purpose in the example in FIG. 1. The dishwasher 1 can be for example a freestanding, integrated or fully integrated dishwasher 1.

Figure 2:
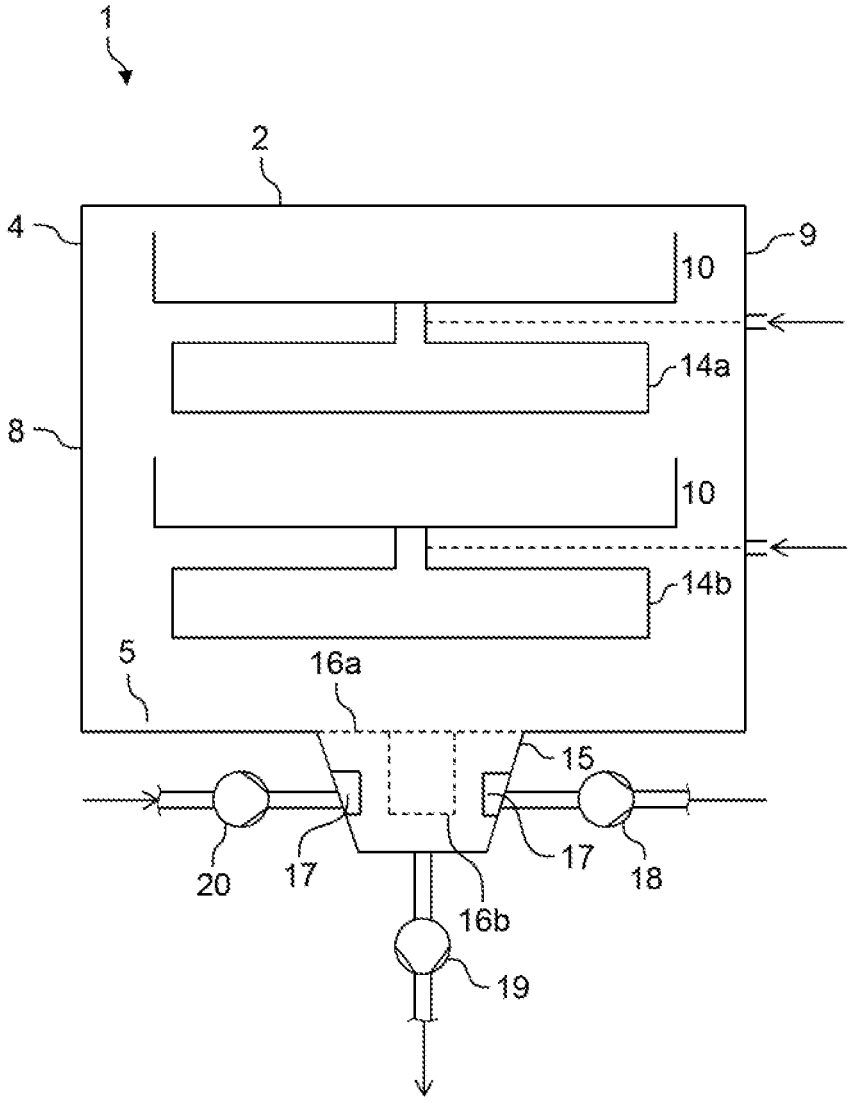
FIG. 2 shows a schematic cross-sectional view of an exemplary embodiment of a dishwashing container of the dishwasher according to FIG. 1.

FIG. 2 shows a schematic cross-sectional view of a dishwashing container 2 of a dishwasher 1 according to FIG. 1. Items to be washed (not shown) can be arranged in the dish holders 10 in the dishwashing container 4. Respective spray arms 14*a*, 14*b* are arranged below the respective dish holders 10, forming a spray device 14 for spraying the items to be washed in the dish holders 10 with dishwashing fluid. A sump 15 is provided with a downstream circulating pump 18 in the region of the base 5 of the dishwashing container 2, being connected to the spray device 14 for flow purposes by way of fluid lines (not shown). The sump 15 here is connected for flow purposes for example to a discharge line, in which a drain pump 19 is arranged to pump soiled dishwashing fluid out of the sump 15.

As shown in FIG. 2, the upper face of the sump 15 is covered by a flat, funnel-shaped filter element 16*a*. A cylindrical filter 16*b* is positioned in the filter element 16*a*. The filter element 16*a* and the cylindrical filter 16*b* form a filter device 16. The cylindrical filter 16*b* serves as a segment of the filter device 16, which filters out dirt particles, which could block the circulating pump 18 and/or the drain pump 19. For further details relating to sump 15 and filter device 16, see WO 2009/077286 A1, the entire contents of which are deemed to be contained herein.

The filtered dirt particles can block the cylindrical filter 16*b* and adversely affect the dishwashing performance of the dishwasher, for which reason automatic cleaning of the cylindrical filter 16*b* is provided in the dishwasher 1. To this end a cleaning device 17 for spraying the sleeve of the cylindrical filter 16*b* with cleaning fluid is arranged in proximity to the cylindrical filter 16*b*. In FIG. 2 the cleaning device 17 is configured around the outer lateral surface of the cylindrical filter 16*b*. Alternatively the cleaning device 17 can also be arranged in the interior of the cylindrical filter 16*b*. The cleaning device 17 is connected to an upstream auxiliary pump 20 for flow purposes, said auxiliary pump 20 applying pressure to the cleaning fluid and conveying it to the cleaning device 17.

Figure 3:
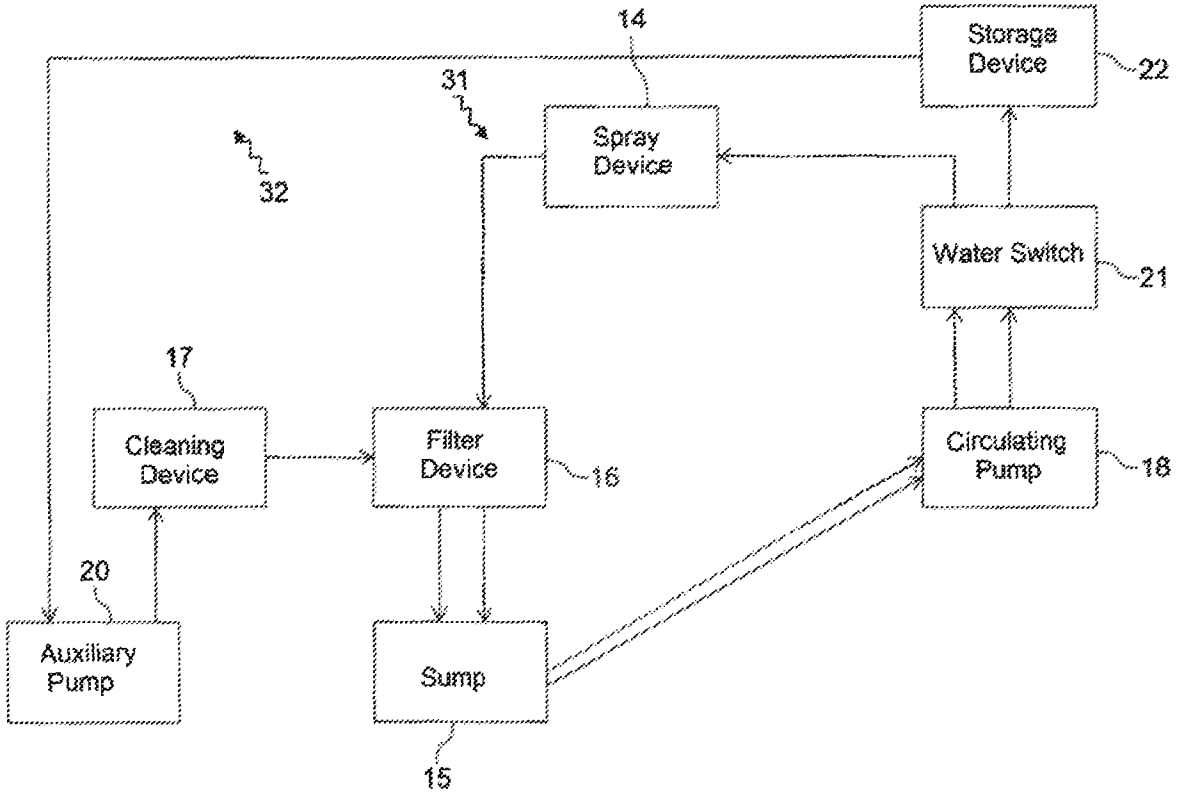
FIG. 3 shows an schematic functional view of a first exemplary embodiment of hydraulic arrangements of the dishwasher.

FIG. 3 shows a schematic functional view of a first exemplary embodiment of hydraulic arrangements 31, 32 of the dishwasher 1.

In particular FIG. 3 shows hydraulic devices 14, 15, 16, 17, 18, 19, 20, 21, 22, which form a first hydraulic arrangement 31 and a second hydraulic arrangement 32.

The first hydraulic arrangement 31 is a hydraulic circuit arrangement and comprises the spray device 14, the filter device 16, the sump 15, the circulating pump 18 and a water switch 21. The filter device 16 in particular comprises a cylindrical filter 16*b*. The above-mentioned hydraulic devices 14, 16, 15, 18, 21 of the first hydraulic arrangement 31 here are connected to one another to form a circuit for flow purposes by way of fluid lines shown as broken arrows. The first hydraulic arrangement 31 is designed to wash the items to be washed that are accommodated in the dishwashing container 2 from FIGS. 1, 2 in a wash mode. In wash mode dishwashing fluid is conveyed by the circulating pump 19 from the sump 15 by way of the water switch 21 to the spray device 14 in the dishwashing container 2, spraying the items to be washed accommodated in the dishwashing container 2 with the dishwashing fluid. The dishwashing fluid mixes with dirt particles adhering to the items to be washed and the dishwashing fluid mixed with dirt particles drops from the items to be washed onto the base 5 of the dishwashing container 2 and drains through the filter device 16, in particular the cylindrical filter 16*b*, into the sump 15. The cylindrical filter 16*b* filters dirt particles out of the dishwashing fluid in the process. In wash mode a column of fluid formed from dishwashing fluid is present in the sump 15 and/or cylindrical filter 16*b*. The dishwashing fluid is circulated out of the sump 15 back toward the water switch 21 and spray device 14.

Figure 5:
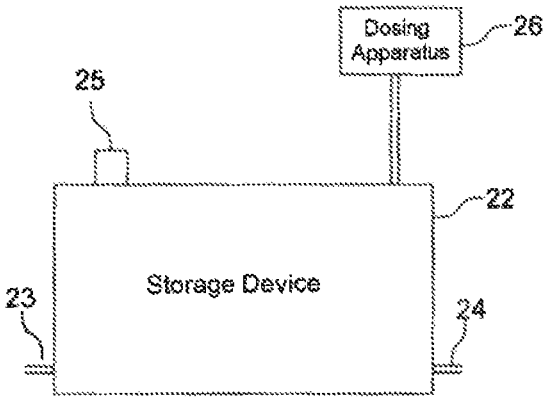
FIG. 5 shows a schematic view of an exemplary embodiment of a storage device.

It should be noted that the first hydraulic arrangement 31 can also be provided with a dishwashing fluid connection (not shown), by way of which the dishwashing fluid is supplied to the first hydraulic arrangement 31 in the wash mode described above at the start of operation of the dishwasher 1. The dishwashing fluid is for example fresh water, to which chemicals are added. The dishwashing fluid can be taken from a dishwashing liquor storage unit for example, as shown in FIG. 5 and described further below.

The second hydraulic arrangement 32 is a hydraulic circuit arrangement and comprises the filter device 16, in particular the cylindrical filter 16*b*, as well as the sump 15, the circulating pump 18, the water switch 21, a storage device 22, the auxiliary pump 20 and the cleaning device 17. The above-mentioned hydraulic devices 16, 15, 17, 18, 20, 21 22 of the second hydraulic arrangement 32 here are connected to one another for flow purposes by way of fluid lines shown as continuous arrows. Where a broken and continuous arrow run parallel, it can be the same fluid line, which is used by both the first hydraulic arrangement 31 and the second hydraulic arrangement 32. The second hydraulic arrangement 32 is designed to clean the cylindrical filter 16*b* by means of cleaning fluid in a cleaning mode. In cleaning mode the cleaning fluid is conveyed by the auxiliary pump 20 from the storage device 22 to the cleaning device 17 and in the in the process subjected to a pressure of for example between 0.5 and 20 bar. Such a high pressure would be for example damaging to items to be washed accommodated in the dishwashing container 2, for which reason the circulating pump 18, which is also contained in the first hydraulic arrangement 31, is not designed to generate such a high pressure. Such a high pressure is however not damaging for the filter device 16. The dimensions of the auxiliary pump 20 are therefore not subject to the same restrictions as those of the circulating pump 18. The cleaning fluid, to which pressure is applied, sprays out of the cleaning device 17 onto the surface of the cylindrical filter 16*b*, cleaning it as a result. The cleaning fluid then passes into the sump 15 and is circulated from there by way of the water switch 21 into the storage device 22 by the circulating pump 18.

The auxiliary pump 20 in particular generates a smaller volumetric flow than the circulating pump 18. This means that all the cleaning fluid reaching the sump 15 is pumped out of the sump 15 immediately and there is no column of fluid in the cylindrical filter 16*b* in cleaning mode. If the cleaning device 17 is arranged inside the cylindrical filter 16*b*, the cleaning fluid can therefore strike the inner lateral surface of the cylindrical filter 16*b* without being slowed down. If the cleaning device 17 is arranged outside the cylindrical filter 16*b*, dirt particles released from the cleaning fluid striking the outer lateral surface of the cylindrical filter 16*b* are not impeded by a column of fluid in the cylindrical filter 16*b* as they exit the cylindrical filter 16*b*.

In the present exemplary embodiment the storage device 22 is a dishwashing liquor storage unit and the cleaning fluid is formed from the dishwashing fluid.

According to the present exemplary embodiment the cleaning fluid is subjected to a high pressure by the auxiliary pump 20. As the auxiliary pump 20 generates a smaller volumetric flow than the circulating pump 18, there is essentially no column of fluid in the cylindrical filter 16*b*. This brings about effective cleaning of the cylindrical filter 16*b* of the filter device 16. Water consumption is low, as circulating dishwashing fluid is used as the cleaning fluid.

Figure 4:
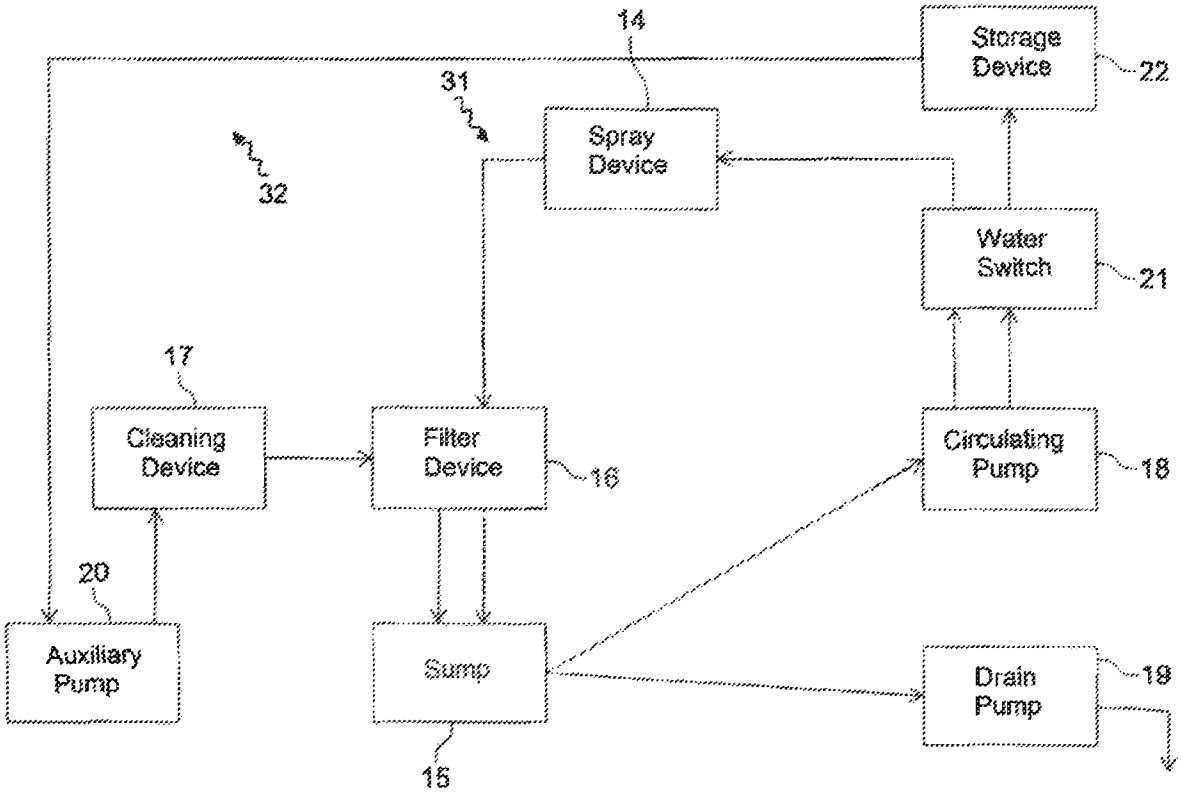
FIG. 4 shows a schematic functional view of a second exemplary embodiment of hydraulic arrangements of the dishwasher.

FIG. 4 shows a schematic functional view of a second exemplary embodiment of hydraulic arrangements 31, 32 of the dishwasher 1. FIG. 5 shows a schematic view of an exemplary embodiment of a storage device 22. The second exemplary embodiment is described in more detail in the following with reference to FIG. 4 and FIG. 5. Elements of identical function in the second exemplary embodiment have the same reference characters as the corresponding elements in the first exemplary embodiment and are not described again.

The second exemplary embodiment shown in FIG. 4 differs from the first exemplary embodiment in that the second hydraulic arrangement 32 is not closed to form a circuit. According to the second exemplary embodiment the sump 15 is connected to the drain pump 19, which conveys cleaning fluid from the sump 15 into sewage, in other words to a sewage line, and in the process generates a larger volumetric flow than the auxiliary pump 20. There is therefore no column of fluid in the cylindrical filter 16*b* and/or in the sump 15 in cleaning mode in the second exemplary embodiment either.

The storage device 22 shown in FIG. 5 is a dishwashing liquor storage unit, which is provided with an inlet 23, an outlet 24, a fresh water connection 25 and an automatic dosing apparatus 26. The inlet 23 is connected for flow purposes to the water switch 21 from FIG. 4. The outlet 24 is connected for flow purposes to the auxiliary pump 20 of the second hydraulic arrangement 32 from FIG. 4. The outlet 24 can also be connected by way of a water switch (not shown) to a dishwashing fluid connection (not shown) of the first hydraulic arrangement 31. The fresh water connection 25 is connected for flow purposes to a pressure valve (not shown) and is designed to fill the storage device 22 with fresh water. The automatic dosing apparatus 26 is designed to add chemicals to the fluid in the storage device 22 to improve its dishwashing and/or cleaning effect.

Use of the storage device 22 allows the cleaning fluid for use in the second hydraulic arrangement 32 to be formed partially from dishwashing fluid circulated from the first hydraulic arrangement 31 by way of the water switch 21 and partially from fresh water to which chemicals have been added. In other words in wash mode or after wash mode before the start of cleaning mode dishwashing fluid, which has been circulated in the first hydraulic arrangement 31 in wash mode, can be conveyed by way of the water switch 21 into the storage device 22 of the second hydraulic arrangement. In cleaning mode used cleaning fluid is conveyed from the sump 15 into sewage by the drain pump 19 and the cleaning fluid that is thus removed is replaced by supplying fresh water to the storage device 22 by way of the fresh water connection 25 and adding chemicals to the cleaning fluid in the storage device 22 by way of the dosing apparatus 26.

According to the second exemplary embodiment the cleaning effect of the cleaning fluid can be improved, as soiled cleaning fluid is not circulated after cleaning and at least some of the cleaning fluid is formed from fresh water. The other advantages of the second exemplary embodiment are the same as the advantages of the first exemplary embodiment.

Figure 6:
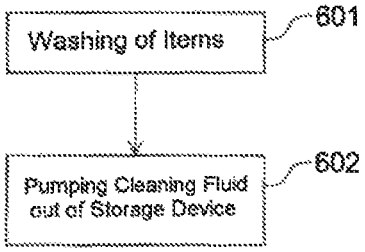
FIG. 6 shows a flow diagram of an exemplary embodiment of a method for operating a dishwasher.

FIG. 6 shows a flow diagram of an exemplary embodiment of a method for operating a dishwasher 1, in particular a household dishwasher, as described for example with reference to FIGS. 1 to 5.

The method comprises a step 601 for washing items to be washed accommodated in a dishwashing container 2 by circulating a dishwashing fluid in a first hydraulic arrangement 31 by means of a circulating pump 18 and a step 602 for cleaning a filter device 16 by means of cleaning fluid in a second hydraulic arrangement 32. The hydraulic arrangements 31, 32 of the method correspond in particular to the hydraulic arrangements 31, 32 of the dishwasher 1 in FIGS. 1 to 5.

The step 602 in particular comprises pumping the cleaning fluid out of the storage device 22 to the cleaning device 17 while the auxiliary pump 20 applies pressure thereto, spraying at least one segment of the filter device 16 with the cleaning fluid by means of the cleaning device 17 and pumping the cleaning fluid out of the sump 16 by means of the pump arrangement, which can comprise the circulating pump 18 and/or the drain pump 19 according to exemplary embodiments.

Although the present invention has been described with reference to exemplary embodiments, it can be modified in many different ways. For example some of the cleaning fluid can be circulated in an alternating manner or simultaneously and some can be conveyed into sewage. In particular if the cleaning fluid is not formed from the dishwashing liquor, the storage device 22 can be any other hollow space with a capacity of preferably at least 2 l, for example a capacitor container of a heat pump-type dishwasher or a water pocket.

The invention claimed is:

1. A dishwasher, comprising:

a dishwashing container accommodating items to be washed;

a first hydraulic arrangement for washing the items by a dishwashing fluid, said first hydraulic arrangement comprising a spray device arranged in the dishwashing container, a sump arranged below the dishwashing container, a filter device configured to filter the dishwashing fluid in the dishwashing container and/or the sump, and a circulating pump configured to circulate the dishwashing fluid to the spray device;

a second hydraulic arrangement for cleaning the filter device by a cleaning fluid, said second hydraulic arrangement comprising the filter device, the sump, a pump arrangement comprising at least the circulating pump, a storage device for holding the cleaning fluid, a cleaning device for spraying at least one segment of the filter device with the cleaning fluid, and an auxiliary pump arranged between the storage device and the cleaning device for applying pressure to the cleaning fluid; and a water switch arranged between the circulating pump, the spray device and the storage device, said water switch including an inlet connected to an outlet of the circulating pump, a first outlet connected to an inlet of the spray device, and a second outlet connected to a dishwashing fluid inlet of the storage device to circulate the dishwashing fluid to the storage device, such that the dishwashing fluid forms at least some of the cleaning fluid, wherein the storage device includes a separate fresh water inlet connection for filling the storage device with fresh water, such that the fresh water forms at least some of the cleaning fluid, with the separate fresh water inlet connection being independent from the dishwashing fluid inlet which is controlled by the water switch, wherein the storage device includes a chemical inlet and an automatic dosing apparatus for adding a chemical to the cleaning fluid in the storage device through the chemical inlet, the chemical being one or more agents that enhance a cleaning effect of the cleaning fluid with respect to the filter device, and wherein the circulating pump is configured to also circulate the cleaning fluid to the storage device via the water switch.

2. The dishwasher of claim 1, constructed in the form of a household dishwasher.

3. The dishwasher of claim 1, wherein the pump arrangement of the second hydraulic arrangement comprises a drain pump for conveying the cleaning fluid into a sewage line.

4. The dishwasher of claim 1, wherein the filter device comprises a number of filters.

5. The dishwasher of claim 4, wherein one filter of the number of filters of the filter device is configured as a cylindrical filter.

6. The dishwasher of claim 1, wherein the auxiliary pump is defined by a volumetric flow which is smaller than a volumetric flow of the pump arrangement.

7. The dishwasher of claim 1, wherein the auxiliary pump is configured to apply an additional pressure between 0.5 bar and 20 bar to the cleaning fluid.

* * * * *